United States Patent [19]

Bacquié et al.

[11] 3,968,650

[45] July 13, 1976

[54] FLUID FEED DEVICE COMPRISING A CONSTANT CYLINDER CAPACITY PUMP AND AT LEAST ONE VARIABLE CYLINDER CAPACITY PUMP

[75] Inventors: Serge B. Bacquié, La-Croix-Saint-Quen; Jean G. Dagnaux, Villers-Saint-Paul, both of France

[73] Assignee: Societe Anonyme: Poclaim, Le-Plessis-Belleville, France

[22] Filed: May 2, 1975

[21] Appl. No.: 574,106

[30] Foreign Application Priority Data

May 15, 1974 France ..... 74.16902

[52] U.S. Cl. ..... 60/428; 60/486

[51] Int. Cl.[2] ..... F15B 11/16; F15B 13/09

[58] Field of Search ..... 60/422, 428, 430, 432, 60/452, 486

[56] References Cited

UNITED STATES PATENTS

| | | | |
|---|---|---|---|
| 3,859,790 | 1/1975 | Bacquie et al. | 60/422 |
| 3,897,174 | 7/1975 | Capelle et al. | 60/428 |

*Primary Examiner*—Edgar W. Geoghegan
*Attorney, Agent, or Firm*—Mason, Fenwick & Lawrence

[57] ABSTRACT

A fluid feed device comprising a constant cylinder capacity pump and at least one variable cylinder capacity pump driven from a single prime mover, the variable cylinder capacity pump being provided with a regulator for reducing its cylinder capacity as the feed pressure increases. The regulator is such as to reduce the power absorbed by the variable cylinder capacity pumps as the pressure increases by an amount equal to the increase in the power absorbed by the constant cylinder capacity pump such that the total power absorbed by the pumps remains constant and equal to the power of the prime mover.

6 Claims, 5 Drawing Figures

FLUID FEED DEVICE COMPRISING A CONSTANT CYLINDER CAPACITY PUMP AND AT LEAST ONE VARIABLE CYLINDER CAPACITY PUMP

This invention relates to feed devices for feeding fluid under pressure to a load from a constant-cylinder-capacity pump and at least one variable-cylinder capacity pump.

The simplest feeding device using constant-cylinder-capacity and variable-cylinder-capacity pumps is that in which one pump of each type feeds in conjunction a single load-circuit.

The circuit must be fed at such pressure and with such flow that the corresponding power is often lower than the maximum power capable of being absorbed by the said circuit. Also, from obvious considerations of cost, the driving-engine of the pumps has a power less than the said maximum power. Accordingly, it is possible to feed the circuit only at a power less than the sum of the absolute maximum powers capable of being absorbed by the pumps. In order to do this, recourse is had to a regulator for regulating the cylinder capacity of the variable-cylinder-capacity pump.

In accordance with prior art the regulation of this variable-cylinder-capacity pump is such that the power absorbed by the said pump is constant. As the power absorbed by the constant-cylinder-capacity pump increases proportionally as a function of the variation of the pressure, the sum of the maximum powers of each pump is in turn a maximum at only one point; that corresponding with the maximum pressure, since the power absorbed by the variable-cylinder-capacity pump is invariable. Operation relative to the said point therefore corresponds with the maximum power of the driving engine of the pumps.

For any other mode of operation the maximum power that the engine can develop is in excess with respect to the power necessary for driving the pumps, which results in poor utilization of the engine.

The intention of the invention is to correct this disadvantage by proposing a new regulation of the cylinder capacity of the variable-cylinder-capacity pump.

The object of the invention is further the application of the aforesaid new regulation to the production of a feed device comprising two variable-cylinder-capacity pumps and one constant-cylinder-capacity pump. This application involves the adaptation of the jacks of the regulators of the two variable-cylinder-capacity pumps.

Accordingly, the present invention provides a device for feeding a load circuit with fluid under pressure through a pipe, comprising two pumps driven by one engine the maximum power of which is less than the sum of the maximum powers of the two pumps, one of the pumps being a constant cylinder-capacity pump and the other pump being a variable-cylinder-capacity pump provided with a regulator for regulating the value of its cylinder capacity, the said regulator comprising a jack having a movable member coupled to a member for regulation of the cylinder capacity of the pump, a chamber connected to the pipe, and a resilient return member acting on the movable member in opposition to fluid pressure in the chamber and tending to displace the movable member in the direction of regulation of the cylinder capacity to its maximum value, the characteristics of initial tension and stiffness of the resilient return member being such that during regulation of the variable-cylinder-capacity pump by the regulator, the power absorbed by the variable-cylinder-capacity pump is a decreasing linear function of the pressure the power absorbed decreasing for a given increase in pressure by an amount to equal in absolute value the corresponding increase in the power absorbed by the constant-cylinder-capacity pump, so that the maximum power absorbed by the two pumps is constant and equal to the maximum power of the engine.

The present invention also provides a device for feeding a load circuit with fluid under pressure by means of three pumps driven by one motor the maximum power of which is less than the sum of the maximum powers of the three pumps, one of the pumps being of constant-cylinder-capacity type and the other pumps each being a variable-cylinder-capacity pump provided with a regulator for regulating the value of its cylinder capacity, the regulators each comprising two jacks having movable members coupled to a member for regulation of the cylinder capacity of the corresponding pump, chambers connected respectively to the deliveries of the two variable-cylinder-capacity pumps, and of a resilient return member acting on the movable members in opposition to fluid pressure in the chambers and tending to displace these movable members in the direction of regulation of the cylinder capacity of the corresponding pump to its maximum value, the deliveries of the constant-cylinder-capacity pump and of a first of the two variable-cylinder-capacity pumps being connected to the said load circuit, whilst the delivery of the second variable-cylinder-capacity pump is selectively either connected to the said load circuit or isolated from this circuit, and the characteristics of initial tension and stiffness of the resilient return member of each regulator being such that when the delivery of the second variable cylinder-capacity pump is connected to the load circuit and regulation of each variable-cylinder-capacity pump is being effected by the regulators, the power absorbed by each variable-cylinder-capacity pump is equal, and the total power absorbed by the two variable-cylinder-capacity pumps is a decreasing linear function of the pressure, the power absorbed decreasing for a given increase in pressure by an amount equal in absolute value to the corresponding increase in the power absorbed by the constant-cylinder-capacity pump, so that the maximum power absorbed by the three pumps is constant and equal to the maximum power of the engine.

The invention will be better understood and secondary characteristics as well as their advantages will become apparent from the following description of preferred embodiments thereof given below by way of example only, reference being had to the accompanying drawings, wherein.

Figure 1:
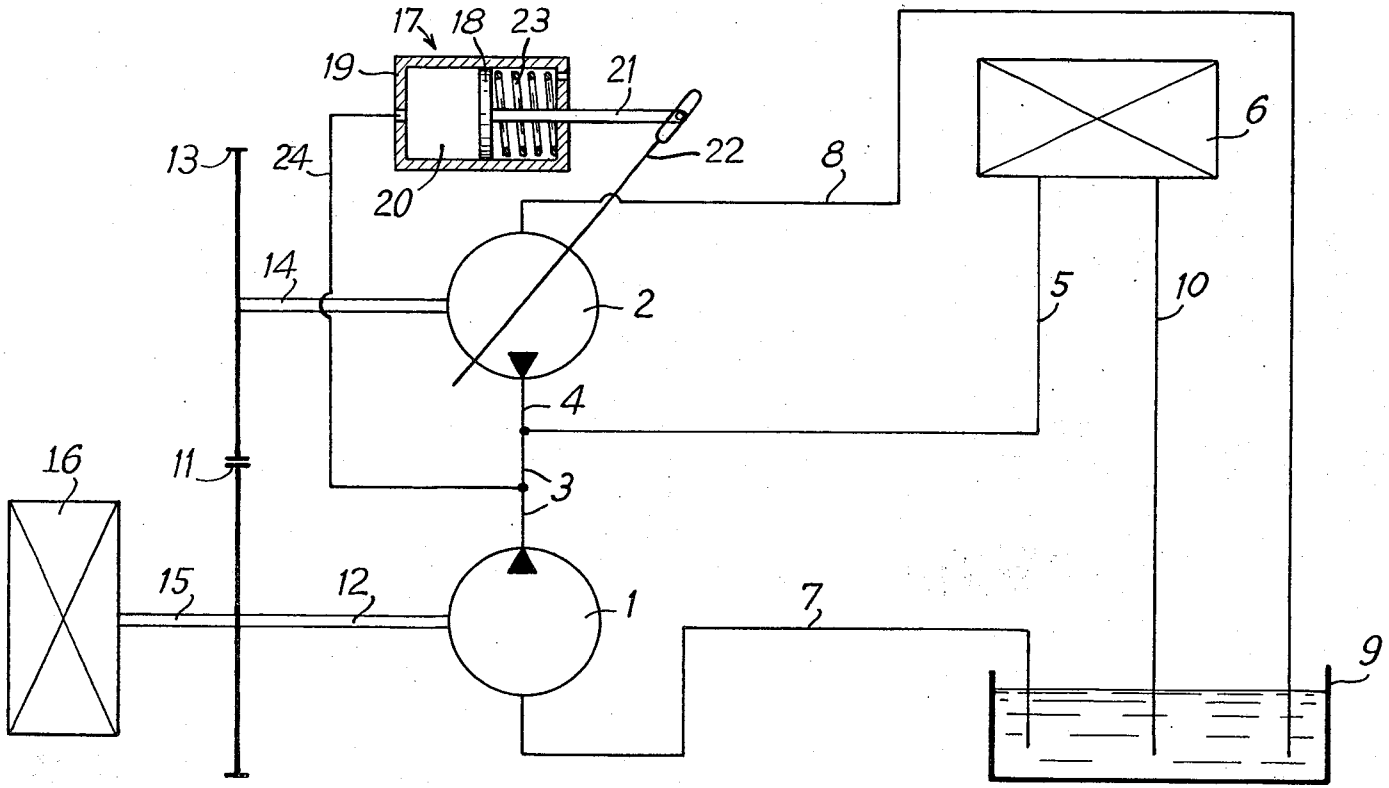
FIG. 1 shows diagrammatically a first embodiment in accordance with the invention.

The device of FIG. 1 comprises a constant-cylinder-capacity pump 1 and a variable-cylinder-capacity pump 2 the respective delivery pipes 3, 4 of which are connected to the feed pipe 5 of a load circuit 6. In known manner the suction pipes 7, 8 of the pumps 1, 2 respectively are connected to a tank of fluid 9. The delivery pipe 10 from the load circuit 6 is also connected to the tank 9.

A pinion 11 is secured to the driving-shaft 12 of the pump 1 and meshes with a pinion 13 secured to the driving-shaft 14 of the pump 2. The output shaft 15 of a driving-engine 16, for example a diesel engine, is coupled to the pinion 11.

A regulator 17 of the cylinder capacity of the pump 2 comprises a jack, the piston 18 of which defines with the body 19 of the jack a chamber 20, and the piston rod 21 of which is coupled to the member 22 for regulation of the cylinder capacity of the pump 2. A spring 23 is interposed between the body 19 and the piston 18 and has an effect tending to move the member 22 to a position corresponding to maximum cylinder capacity. The spring 23 has moreover an effect opposed to that of the fluid contained in the chamber 20. A pipe 24 connects the pipe 3 to the chamber 20 to place the chamber 20 in fluid communication with feed pipe 5.

Figure 2:
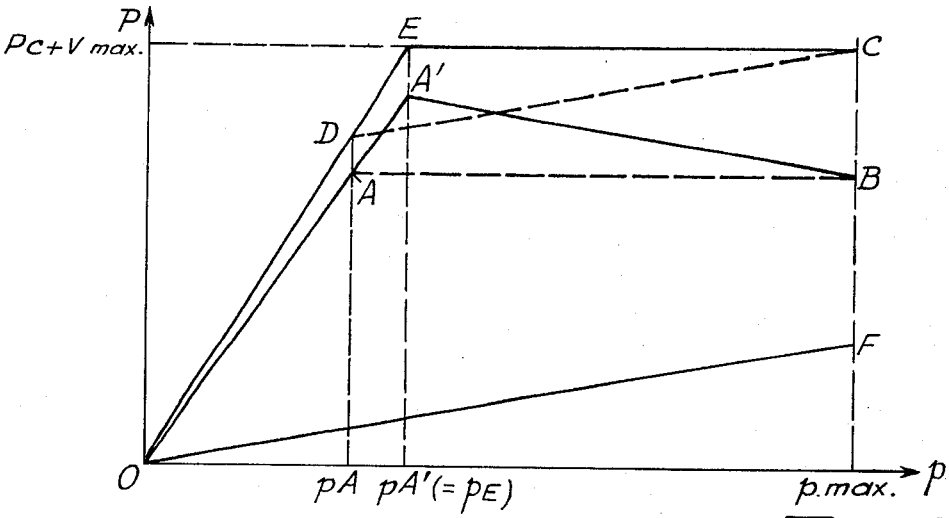
FIGS. 2 and 3 are graphs representing the operation of the device as FIG. 1.

The graph of FIG. 2 indicates variation of power P as a function of pressure p. Operation of the constant-cylinder-capacity pump 1 is represented by the straight line OF:

$$Pc = p \times Qc \qquad 1.$$

Pc and Qc being the power absorbed and the output flow rate from the constant-cylinder-capacity pump 1.

If the variable-cylinder-capacity pump 2 has been furnished with a conventional regulator its operation would be that represented by the contiguous segments of straight-lines OA and AB. Along OA the regulator is not in action. It is in action along AB where one has:

$$Pv = p \times Qv = \text{constant} \qquad 2.$$

Pv and Qv being the power absorbed and the output flow rate from the pump 2 (with a conventional regulator).

The sum of the powers absorbed would in that case be represented by the two segments of straight-lines OD and DC along which:

$$Pc{+}v = Pc{+}Pv \qquad 3.$$

where Pc+v is the sum of the powers.

The maximum value of Pc+v is located at the point C where:

$$Pc{+}vMAX = PcMAX + Pv \qquad 4.$$

Pc+vMAX and PcMAX being the maximum values of the sum of the powers and of the power of the pump 1. The driving engine 16 must be able to develop this power Pc+vMAX. The maximum available power of the engine 15 only used at the point C of maximum pressure pMAX, the sum Pc+v being everywhere else less than Pc+vMAX. The known arrangement therefore makes poor use of the total power available from the driving engine.

What is achieved by the invention is the replacement of the variation OD, DC of Pc+v by two new segments of straight lines OE and EC, in which OE is superimposed upon OD and extends this line, and EC is a segment along which Pc+v = Pc+vMAX. In this case regulation uses fully the maximum power of the driving engine 16. This is rendered possible by regulating the variable-cylinder-capacity pump 2 in accordance with the two segments of straight lines OA′ and A′B. OA′ is superimposed upon OA and extends it up to the point A′ which corresponds with the pressure pE whilst A′B connects A′ with B.

Letting the reduction of the cylinder capacity of the pump 2 intervene only at A′ is tantamount to delaying putting this regulation into effect. In other words at constant cylinder capacity and hence flow the pressure is increased but without actuating the member 22 for regulation of the cylinder capacity. The pressure pA′ at A′ being higher than the pressure pA at A the force applied by the spring 23 at A′ must be higher than what it was at A. The force applied by spring 23 must however remain uncharged at the point B. It will be understood that as compared with the characteristics of a spring of a conventional regulator which would regulate along AB, a spring 23 in an embodiment of the invention will have an initial tension which is higher than that of the spring of the previously known regulator and a stiffness which is lower than that of the spring of the previously known regulator, this being in order that the force from the spring increases less rapidly along A′B than along AB and thus enables the point of operation B to be struck again.

The gain in power obtained by the adoption of the new arrangement is easily observed, being the gain corresponding on the graph of FIG. 2 within the triangle DEC.

Figure 3:
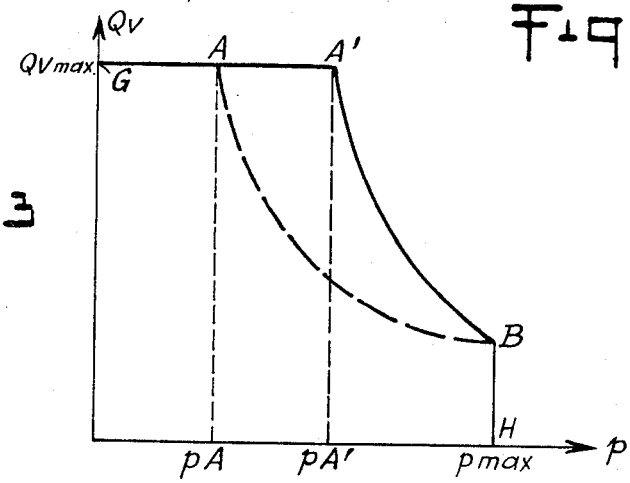

In FIG. 3 is represented the variation in the output flow rate Qv from the variable-cylinder-capacity pump 2 as a function of the output pressure p. The maximum flow from the pump 2 is designated QvMAX.

With conventional regulation the output flow rate is represented by the line GABH, AB being the hyperbola Qv X $p$ = constant, G being the point corresponding to QvMAX and $p$ = O, and H being the point corresponding with pMAX and Qv = O. In an embodiment of the invention the output flow rate is represented by the line GA′BH. It is clear that for a given flow rate the pressure is higher along A′B than along AB and that for a given pressure the flow rate is higher along AA′B than along AB.

As a reminder, it may be recalled that in a variable-cylinder-capacity pump having a plate tiltable by an angle A with the perpendicular to the axis of the pistons, $$Qv = M\tan A \qquad 5.$$

If L is the distance from the axis of the regulator to the axis of oscillation of the tiltable plate, K the stiffness of the spring 23, S the cross-section of the jack of the regulator 17, one has for this regulator:

$$pS = -KL\tan A + KL\tan Ao \qquad 6.$$

LtanAo representing the calibration of the spring 23.

From (5) and (6) Qv is given as a function of the initial tension and the stiffness:

$$Qv = M\tan Ao - (MSp/KL) \qquad 7.$$

The foregoing arrangement may be adapted and applied to the following case of a feed device having one constant-cylinder-capacity pump 25 and two identical variable-cylinder-capacity pumps 26 and 27.

The driving shafts 28, 29, 30 of the pumps 25, 26, 27 are secured to pinions 31, 32, 33 respectively. The pinion 32 is coupled to the output shaft 34 of an engine 35 for driving the three pumps.

The pump 25 is connected to a tank 36 by a suction pipe 37 and to the feed pipe 38 of a first load circuit 39 by a delivery pipe 40. This circuit 39 is itselt connected to the tank 36 by a delivery pipe 41. The first variable-cylinder-capacity pump 26 is connected to the tank 36 by a suction pipe 42 and to the pipe 38 by a delivery pipe 43. The second variable-cylinder-capacity pump 27 is connected to the tank 36 by a suction pipe 44 and to a three-position distributor 45 by a delivery pipe 46.

The distributor 45 is connected to the tank 36 by a pipe 47, to a second load circuit 48 by a pipe 49, and to the feed pipe 38, of the first circuit by a pipe 50. Its three positions provide the following arrangements:

The first position, the connection of pipe 46 to pipe 47 and the blocking of pipes 49 and 50;

The second position, the connection of pipe 46 to pipe 49 and the blocking of pipes 47 and 50; and The third position, the connection of pipe 46 to pipe 50 and the blocking of pipes 47 and 49. The second circuit 48 is connected to the tank 36 by a delivery pipe 51.

To the members 52, 53 for regulation of the cylinder capacity of the pumps 26, 27 are coupled the respective piston rods 54 of regulators 55 of the value of the cylinder capacity. Each regulator 55 comprises a body 56 inside which two pistons 57 and 58 define two distinct chambers 59 and 60. The pistons 57 and 58 bear against a plate 61 secured to the rod 54. Further, a spring 62 is interposed between each body 56 and the plate upon which the respective pistons 57 and 58 bear and has an effect which tends to put the regulating members 52 and 53 in the position corresponding to the highest cylinder capacity. Fluids contained in the chambers 59 and 60 have on the pistons an effect opposed to that of the springs 62. The chamber 59 of the regulator of the pump 26 is connected by a pipe 63 to the pipe 40, the chamber 60 of the same regulator being connected by a pipe 64 to the pipe 46. Similarly the chamber 60 of the regulator of the pump 27 is connected by a pipe 65 to the pipe 40, whilst the chamber 59 of the same regulator is connected by a pipe 66 to the pipe 46.

Figure 5:
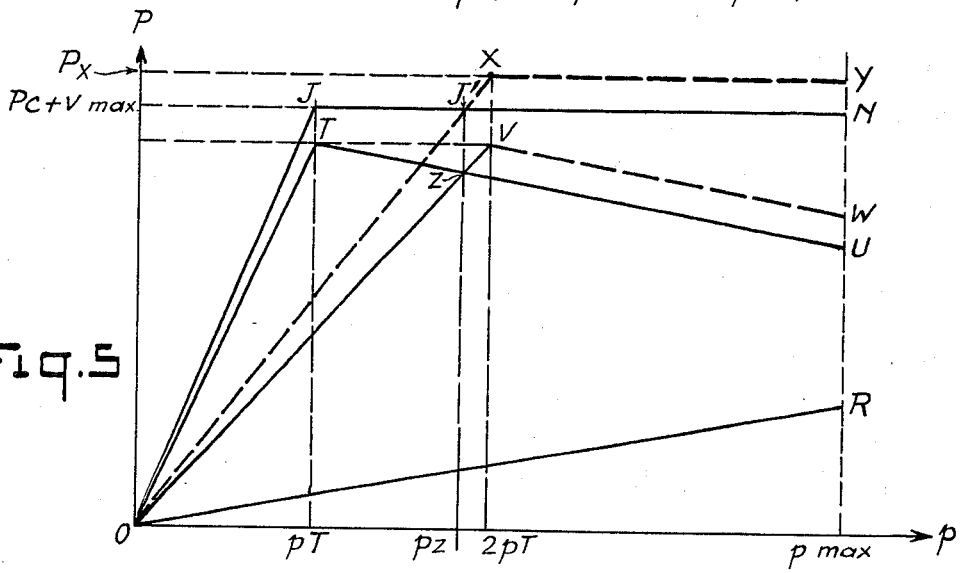
FIG. 5 is the graph representing the operation of the device as FIG. 4.
Figure 4:
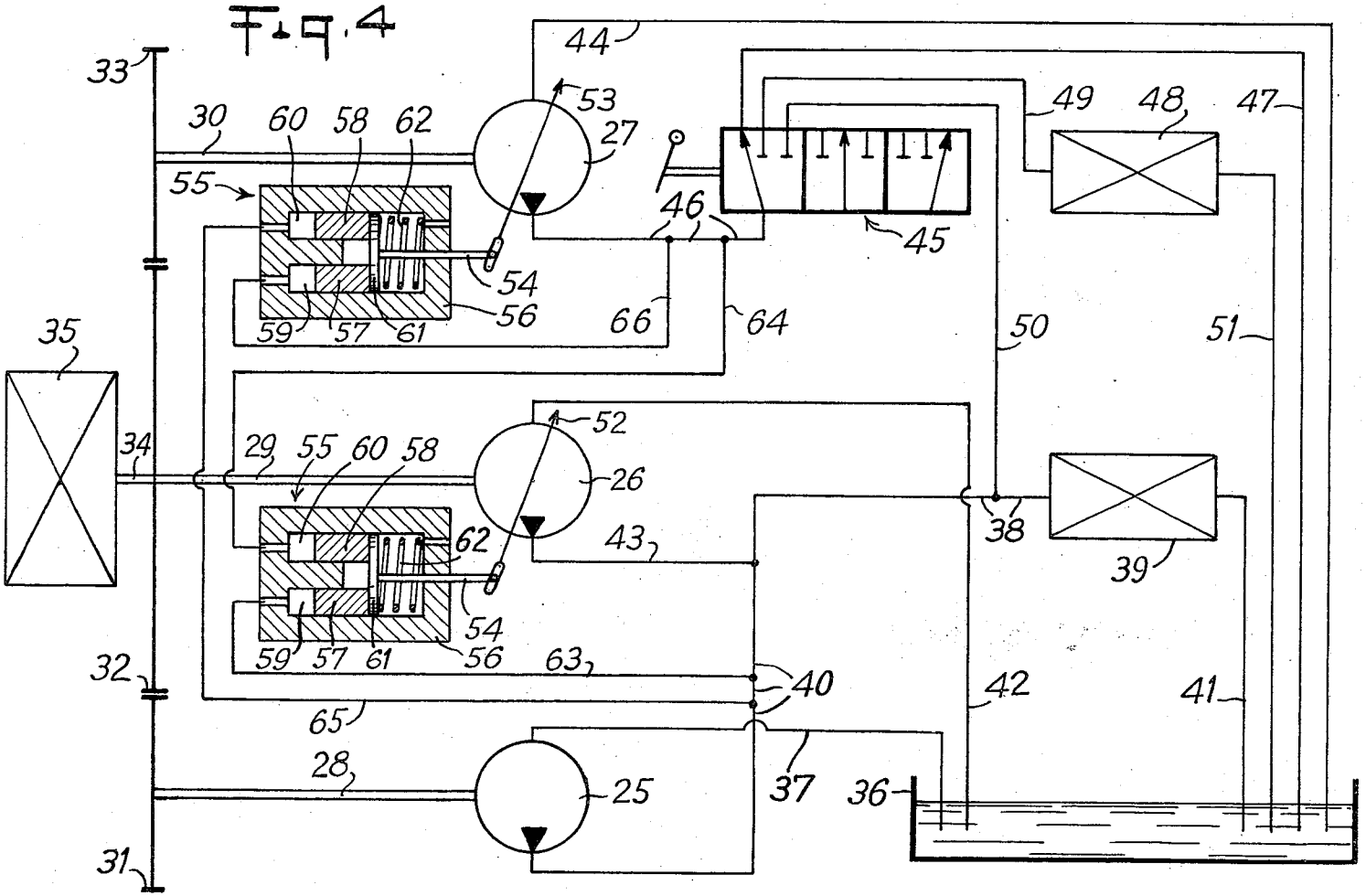
FIG. 4 shows diagrammatically a second embodiment in accordance with the invention.

FIG. 5 shows the operation of the device of FIG. 4. It will be recalled that the pumps 26 and 27 are identical and that their regulators 55 are also identical. The cross-sections of the chambers 59 and 60 of a regulator are referenced $S_{59}$and $S_{60}$ respectively and are unequal at a ratio between them that will be given later.

Considering firstly the sum $S_{55}$ of the cross-sections $S_{59}$ and $S_{60}$ of a regulator 55 and the operation resulting from putting the distributor 45 in its third position.

We have:

$$S_{59} + S_{60} = S_{55} \qquad 8.$$

Having in addition selected the initial tension and the stiffness of the spring 62 in accordance with the method indicated previously with regard to FIGS. 1 and 3, one can without difficulty obtain the curve of the total maximum power absorbed by the three pumps 25, 26 and 27, which is represented by the segment of straight line JN corresponding with Pc+vMAX and with the maximum power of the driving engine 35.

The segment of straight line OR represents the variation in the power Pc absorbed by the constant-cylinder-capacity pump 25 (and hence at constant flow Qc) as a function of the pressure: Pc = p X Qc.

The segment of straight line TU represents the variation in the total power 2Pv absorbed by the two variable-cylinder-capacity pumps 26 and 27 during actual regulation of their cylinder capacity, with the distributor 45 still in its third position: 2Pv = p X (QvX2) = 2pXQv, Pv being the power absorbed by one of the pumps 26 and 27, Qv the output flow rate of this pump. Of course OJ and OT represent the variations respectively in Pc+v and in 2Pv before regulation of the cylinder capacities by the regulators 55 starts to take place, this regulation starting only at the point T at the pressure pT.

If the cross-sections $S_{59}$ and $S_{60}$ were equal, as they are in accordance with known prior art, putting the distributor 45 in its first position would mean that regulation of the variable-cylinder-capacity pump 26 which continues to feed the circuit 39, would intervene only at a pressure 2pT, since putting the distributor 45 in its first position effectively reduces to zero the pressure in chamber 60 of the regulator of pump 26. The effect which is opposed to that of the spring 62 of the regulator of pump 26 is then only that produced by fluid contained in chamber 59 of the said regulator. Acting only upon $S_{59}$ instead of upon $S_{59} + S_{60}$ as previously, this pressure will have an identical effect upon the said spring only by having a value double from that needed when the distributor 45 is in its third position.

Hence the regulation of the pump 26 starts at the point V for an unchanged flow Qv (the regulator 55 being in the same position, and the regulating member 52 which is coupled to it being likewise in the same position), but for a pressure 2pT. The regulation is in that case effected in parallel with the segment of straight line TU along VW and ends for pMAX at the point W for which the power Pv is higher than the power Pv at U.

The result from the point of view of the overall power absorbed by the two pumps 25 and 26 which continue feeding the circuit 39, is to obtain variation along OX then along XY and to end along XY at a power Pc+v = Px, a value higher than Pc+vMAX and hence higher than the maximum power of the engine 35. Maintaining in accordance with prior art the equality of the cross-sections $S_{59}$ and $S_{60}$ prohibits driving of the pumps 25 and 26 to feed the circuit 39 whilst the pump 27 is delivering to the tank.

An embodiment of the invention provides an adaptation of the cross-sections $S_{59}$ and $S_{60}$ which enables starting the regulation of the pump 26 during feeding of the circuit 39 by the pumps 25 and 26, not at the point V but at the point of intersection Z between OV and TU, from a pressure pZ intermediate pT and 2pT. Thus the regulation of the pump 26 in the operational case being considered, will be effected along ZU. The variation in the total power Pc+v absorbed by the pumps 25 and 26 is represented by the segments of straight line OJ' and J'N. This power is limited along J'N to Pc+vMAX and therefore does not exceed the maximum power of the engine 35.

The ratio of the cross-sections $S_{59}$ and $S_{60}$ is chosen such that the pressure pZ acting on $S_{59}$ develops the same force of compression of the spring 62 as the pressure pT acting upon $(S_{59} + S_{60})$. Taking into account the fact that $(S_{59} + S_{60}) = S_{55}$ must remain constant one has:

$$S_{59} + S_{60} = S_{55} \text{ (=constant)} \quad 8.$$

$$S_{55} \times pT = S_{59} \times pZ \quad 9.$$

Thus:

$$S_{59} = S_{55} \times (pT/pZ) \quad 10.$$

$$S_{60} = S_{55} \times [(pZ - pT)/pZ] \quad 11.$$

$S_{55}$ is defined as being the overall cross-section selected for each regulator 55, which enables regulation of the feed with three pumps along the segments of straight line OJ, JN, this being after taking into account the stiffness and the initial tension adopted for the springs 62.

If one now examines the operation obtained with the cross-sections $S_{59}$ and $S_{60}$ in accordance with (10) and (11), when the distributor 45 is put in its second position, it is seen first of all that the circuit 39 is fed by the pumps 25 and 26 with fluid the pressure of which is p39, whilst the other circuit 48 is fed by the pump 27 with fluid the pressure of which is p48.

The forces from the pressure on the pistons 57 and 58 of the regulators will give an overall force of compression of the corresponding springs 62, the values of which will be: For the regulator 55 of the pump 26:

$$S_{59} \times p39 + S_{60} \times p48 \quad 12.$$

For the regulator 55 of the pump 27:

$$S_{59} \times p48 + S_{60} \times p39 \quad 13.$$

The mean force will therefore be equal to:

$$F \text{ mean} = (S_{59}+S_{60}) \times (p39+p48)/2 \quad 14.$$

What is claimed is:

1. A device for feeding a load circuit with fluid under pressure through a pipe, comprising two pumps driven by one engine the maximum power of which is less than the sum of the maximum powers of the two pumps, one of the pumps being a constant cylinder-capacity pump and the other pump being a variable-cylinder-capacity pump provided with a regulator for regulating the value of its cylinder capacity, the said regulator comprising a jack having a movable member coupled to a member for regulation of the cylinder capacity of the pump, a chamber connected to the pipe, and a resilient return member acting on the movable member in opposition to fluid pressure in the chamber and tending to displace the movable member in the direction of regulation of the cylinder capacity to its maximum value, the characteristics of initial tension and stiffness of the resilient return member being such that during regulation of the variable-cylinder-capacity pump by the regulator the power absorbed by the variable-cylinder-capacity pump is a decreasing linear function of the pressure, the power absorbed decreasing for a given increase in pressure by an amount to equal in absolute value the corresponding increase in the power absorbed by the constant-cylinder-capacity pump, so that the maximum power absorbed by the two pumps is constant and equal to the maximum power of the engine.

2. A feed device according to claim 1 wherein the initial tension and the stiffness of the resilient return member are respectively higher and lower than the initial tension and the stiffness of the resilient return member which would be employed in the regulator if it was desired to limit the maximum power of the variable-cylinder-capacity pump to a constant value equal to the power of the cylinder-capacity pump at the maximum pressure of the feed device.

3. A device for feeding a load circuit with fluid under pressure by means of three pumps driven by one motor the maximum power of which is less than the sum of the maximum powers of the three pumps, one of the pumps being of constant-cylinder-capacity type and the other pumps each being a variable-cylinder-capacity pump provided with a regulator for regulating the value of its cylinder capacity, the regulators each comprising two jacks having movable members coupled to a member for regulation of the cylinder capacity of the corresponding pump, chambers connected respectively to the deliveries of the two variable-cylinder-capacity pumps, and of a resilient return member acting on the movable members in opposition to fluid pressure in the chambers and tending to displace these movable members in the direction of regulation of the cylinder capacity of the corresponding pump to its maximum value, the deliveries of the constant-cylinder-capacity pump and of a first of the two variable-cylinder-capacity pumps being connected to the said load circuit, whilst the delivery of the second variable-cylinder-capacity pump is selectively either connected to the said load circuit or isolated from this circuit, and the characteristics of initial tension and stiffness of the resilient return member of each regulator being such that when the delivery of the second variable cylinder-capacity pump is connected to the load circuit and regulation of each variable-cylinder-capacity pump is being effected by the regulators, the power abosrbed by each variable-cylinder-capacity pump is equal, and the total power absorbed by the two variable-cylinder-capacity pumps is a decreasing linear function of the pressure, the power absorbed decreasing for a given increase in pressure by an amount equal in absolute value to the corresponding increase in the power absorbed by the constant-cylinder-capacity pump, so that the maximum power absorbed by the three pumps is constant and equal to the maximum power of the engine.

4. A feed device according to claim 3 wherein the initial tension and the stiffness of the resilient return member of the regulator of one of the two variable-cylinder-capacity pumps is respectively higher and lower than the initial tension and the stiffness of the resilient return member which would be employed in the regulator if it was desired to limit the maximum power of the one variable-cylinder-capacity pump to constant value equal to its power at the maximum pressure of the feed device.

5. A feed device according to claim 3 wherein the cross-sections of the two jacks of one regulator are such that when the delivery of the second variable-cylinder-capacity pump is isolated from the load circuit and is put into communication with a return at no pressure and the regulation of the first variable-cylinder-capacity pump is being effected by its regulator, the power absorbed by the said first pump remains a decreasing linear function of the pressure, the function being such that the maximum power absorbed by the three pumps is constant and equal to the maximum power of the engine.

6. A device according to claim 5 wherein the cross-section of that jack of each regulator, the chamber of which is connected to the delivery of the pump corresponding to that regulator, is larger than the half the sum of the cross-sections of the two jacks of that regulator, the said sum being equal to the sum of the cross-sections of the jacks of that regulator if the variable-cylinder-capacity pumps were both connected permanently to the load circuit.

* * * * *

UNITED STATES PATENT AND TRADEMARK OFFICE

CERTIFICATE OF CORRECTION

PATENT NO. : 3,968,650

DATED : July 13, 1976

INVENTOR(S) : Serge B. Bacquie and Jean G. Dagnaux

It is certified that error appears in the above-identified patent and that said Letters Patent are hereby corrected as shown below:

The proper reference to the Assignee should read:

-- Assignee: Societe Anonyme: Poclain --

Signed and Sealed this

Fourteenth Day of September 1976

[SEAL]

*Attest:*

RUTH C. MASON
*Attesting Officer*

C. MARSHALL DANN
*Commissioner of Patents and Trademarks*